US007736493B2

(12) United States Patent
Leta et al.

(10) Patent No.: US 7,736,493 B2
(45) Date of Patent: Jun. 15, 2010

(54) DEASPHALTER UNIT THROUGHPUT INCREASE VIA RESID MEMBRANE FEED PREPARATION

(75) Inventors: Daniel P. Leta, Flemington, NJ (US); Lisa M. Rogers, League City, TX (US); Merryl J. Miranda, Arlington, VA (US); Keith K. Aldous, Winchester, VA (US); Stephen M. Cundy, Lebanon, NJ (US); MaryKathryn Lee, Plainfield, NJ (US); Edward W. Corcoran, Easton, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 414 days.

(21) Appl. No.: 11/980,161

(22) Filed: Oct. 30, 2007

(65) Prior Publication Data

US 2009/0057192 A1 Mar. 5, 2009

Related U.S. Application Data

(60) Provisional application No. 60/966,474, filed on Aug. 28, 2007.

(51) Int. Cl.
*C10G 21/00* (2006.01)

(52) U.S. Cl. ..... 208/309; 208/45

(58) Field of Classification Search ..... 208/45, 208/309

See application file for complete search history.

(56) References Cited

U.S. PATENT DOCUMENTS 2,947,687 A 8/1960 Lee
3,684,697 A 8/1972 Gamson
3,919,075 A 11/1975 Parc et al.
3,929,616 A 12/1975 Mead et al.
3,990,963 A 11/1976 Audibert et al.
4,115,465 A 9/1978 Elfert et al.
4,120,900 A 10/1978 Evers et al.
4,169,782 A 10/1979 Thompson (Continued)

FOREIGN PATENT DOCUMENTS

CA 2185264 9/1996

(Continued)

OTHER PUBLICATIONS

Speight, J.G. (1999). The Chemistry and Technology of Petroleum, Marcel-Dekker, 918 pgs. (Office action cited p. 735).*

(Continued)

*Primary Examiner*—Robert J Hill, Jr.
*Assistant Examiner*—Brian McCaig
(74) *Attorney, Agent, or Firm*—Bruce M. Berdelon

(57) ABSTRACT

The present invention relates to a process for improving a deasphalting unit process by producing an improved feedstream for the deasphalting process via ultrafiltration of a vacuum resid-containing feedstream. In particular, the present invention produces an improved quality feedstream to a solvent deasphalting process which results in improved deasphalted oil (DAO) production rates and/or higher quality deasphalted oils. The present invention can be particularly beneficial when used in conjunction with an existing deasphalting equipment to result in improved deasphalted oil (DAO) production rates and/or higher quality deasphalted oils from the existing deasphalting equipment without the need for significant equipment modifications to the existing deasphalting unit.

23 Claims, 2 Drawing Sheets

U.S. PATENT DOCUMENTS

| | | | |
|---|---|---|---|
| 4,259,170 | A | 3/1981 | Graham et al. |
| 4,411,790 | A | 10/1983 | Arod et al. |
| 4,504,377 | A | 3/1985 | Shu et al. |
| 4,592,832 | A | 6/1986 | Bristow et al. |
| 4,661,241 | A | 4/1987 | Dabkowski et al. |
| 4,797,200 | A | 1/1989 | Osterhuber |
| 4,814,088 | A | 3/1989 | Kutowy et al. |
| 4,816,140 | A | 3/1989 | Trambouze et al. |
| 4,874,523 | A | 10/1989 | LaFreniere |
| 4,892,660 | A | 1/1990 | Sweet |
| 4,908,134 | A | 3/1990 | Anderson |
| 4,946,594 | A | 8/1990 | Thaler et al. |
| 4,963,303 | A | 10/1990 | Anderson |
| 4,978,454 | A | 12/1990 | Sweet |
| 4,982,051 | A | 1/1991 | Pasternak et al. |
| 5,045,206 | A | 9/1991 | Chen et al. |
| 5,045,354 | A | 9/1991 | Feimer et al. |
| 5,107,056 | A | 4/1992 | Chen et al. |
| 5,107,058 | A | 4/1992 | Chen et al. |
| 5,107,059 | A | 4/1992 | Chen et al. |
| 5,173,172 | A | 12/1992 | Adams et al. |
| 5,178,750 | A | 1/1993 | Mead |
| 5,180,496 | A | 1/1993 | Sartori et al. |
| 5,191,151 | A | 3/1993 | Eriksen et al. |
| 5,256,297 | A | 10/1993 | Feimer et al. |
| 5,514,252 | A | 5/1996 | Kerby, Jr. et al. |
| 5,635,055 | A | 6/1997 | Sweet et al. |
| 5,643,442 | A | 7/1997 | Sweet et al. |
| 5,749,943 | A | 5/1998 | Shimazu et al. |
| 5,785,860 | A | 7/1998 | Smith |
| 6,180,008 | B1 | 1/2001 | White |
| 6,187,987 | B1 | 2/2001 | Chin et al. |
| 6,274,030 | B1 | 8/2001 | Wallace et al. |
| 6,524,469 | B1 | 2/2003 | Schucker |
| 6,525,469 | B1 | 2/2003 | Huang et al. |
| 6,896,796 | B2 | 5/2005 | White et al. |
| 7,018,517 | B2 | 3/2006 | Kurita et al. |
| 7,041,212 | B2 | 5/2006 | White et al. |
| 7,048,846 | B2 | 5/2006 | White et al. |
| 2003/0019790 | A1 | 1/2003 | Schucker |
| 2004/0026321 | A1 | 2/2004 | Minhas et al. |
| 2004/0251166 | A1 | 12/2004 | Alvarenga et al. |
| 2004/0251201 | A1 | 12/2004 | Chau et al. |
| 2006/0016727 | A1 | 1/2006 | Varadaraj |
| 2007/0090020 | A1 | 4/2007 | Buchanan et al. |
| 2008/0116109 | A1 | 5/2008 | McCoy et al. |

FOREIGN PATENT DOCUMENTS

| | | | |
|---|---|---|---|
| EP | 0160142 | | 11/1985 |
| EP | 0254359 | B1 | 1/1988 |
| EP | 0146298 | B1 | 5/1991 |
| EP | 0489573 | B1 | 9/1995 |
| GB | 1266180 | | 12/1969 |
| GB | 2268186 | | 1/1994 |
| JP | 54013509 | | 7/1977 |
| JP | 2000288371 | | 4/1999 |
| JP | 2001038159 | | 8/1999 |
| KR | 2002007235 | | 1/2002 |
| WO | WO 00/06526 | | 2/2000 |
| WO | WO 01/60771 | A1 | 8/2001 |
| WO | WO 02/50212 | A2 | 6/2002 |
| WO | WO 03/026781 | A1 | 4/2003 |
| WO | WO 2006/040328 | A1 | 4/2006 |

OTHER PUBLICATIONS

V. S. Ravi-Kumar, Theodore T. Tsotsis, Muhammad Sahimi; "Studies of Transport of Asphaltenes through Membranes Using Hindered Diffusion Theories for Spheres and Spheroids," Ind. Eng. Chem. Res. 1997, 36, pp. 3154-3162.

Anna Duong, Goutam Chattopadhyaya, Wellington Y. Kwok, Kevin J. Smith; "An experimental study of heavy oil ultrafiltration using ceramic membranes," Fuel, vol. 76, No. 9, pp. 821-828, 1997.

B. D. Sparks, J. D. Hazlett, O. Kutowy, T. A. Tweddle; "Upgrading of Solvent Extracted Athabasca Bitumen by Membrane Ultrafiltration," AIChe Journal, Aug. 1990, vol. 36, No. 8, pp. 1279-1282.

Bruce Bishop, Robert Goldsmith, Robert Schucker, Keith Rawlins; "Ceramic Membrane Process for Upgrading Vacuum Residual Oil," Presentation at AIChE 2004 Spring Annual Meeting, New Orleans, LA, Apr. 25-29, 89d.

W. C. Lai, K. J. Smith; "Heavy oil microfiltration using ceramic monolith membranes," Fuel 80 (2001) pp. 1121-1130.

J. D. Hazlett, O. Kutowy, T. A. Tweddle, B. A. Farnand; "Processing of crude oils with polymeric ultrafiltration membranes," AIChE 1989 Spring National Meeting (Houston Apr. 2-6, 1989) AIChE Symposium Series V85 N. 272, 101-107 (1989).

Deqing Shi, Hongwei Yu, Jinrong Yang, Zhihau Zhang,Ying Kong; "Study on the separation performance of polyimide nanofiltration membrane for solvent recovery in the butanone-toluene dewaxing process of lube oil," Mo Kexue Yu Jishu (2005), 25(3), 50-53, 62. Abstract.

Zhi-Ping Zhao, Jiding Li, Jian Chen, Cui-Xian Chem; "Nanofiltration membrane prepared from polyacrylonitrile ultrafiltration membrane by low-temperature plasma," Journal of Membrane Science (2005), 251(1-2), 239-245. Abstract.

F. Petrus Cuperus, Katrin Ebert; "Non-aqueous application of NF," Nanofiltration (2005), 521-536, Editor(s): Schafer, A.I.; Fane, A.G.; Waite, Thomas D., Publisher: Elsevier Ltd., Oxford, UK. Abstract.

B. Bishop, R. Goldsmith, R. Schucker, K. Rawlins; "Ceramic membrane process for upgrading vacuum residual oil," 2004 AIChE Spring Meeting, Conference Proceedings, New Orleans, LA, 7p (2004) Abstract.

M. V. Veazey; "Tech trends: Microfiltration system," Materials Performance 43/5 15 (May 2004), Abstract.

T. Melin, M. Gallenkemper, J. Hoppe, C. Matthias, "Achema reports . Membrane engineering," Chemie-Ingenieur-Technik (Achema 2003 27(sup) t(sup) h International Exhibition—Congress on Chemical Engineering, 76/12 1869-1876, Dec. 2003., Abstract.

V. I. Il'In, V. A. Kolesnikov, A. V. D'Yachenko; "Electrically insulating petroleum oils and their refining," Oboronnyi Kompleks—Nauchno—Tekhnicheskomu Progressu Rossii (2002), (4), 69-71. Abstract.

A. P. Aleksandrin, A. A. Egorshev, O. V. Katsereva, E. A. Komyagin, V. N. Mynin, G. V. Terpugov; "Use of ceramic membranes for treatment end regeneration of depleted petroleum products," Tyazh. Mashinostr. -/6 30-32 (2002) Chemical Abstracts 138/5-6 Abstr. No. 58512 (2003). Abstract.

"Process industries exposition: Membrane rejects emulsified oils while maintaining hydrophilic properties," Chemical Engineering Progress 97/4 26 (Apr. 2001). Abstract.

K. J. Smith, W. C. Lai; "Heavy oil microfiltration using ceramic monolith membranes," Fuel, 80/8, 1121-1130 (Jun. 2001). Abstract.

R. M. Gould, L. S. White, C. R. Wildemuth; "Membrane separation in solvent lube dewaxing," Environmental Progress, 20/1, 12-16 (Apr. 2001). Abstract.

N. A. Bhore, R. M. Gould, S. M. Jacob, P. O. Staffeld, D. McNally, P. H. Smiley, C. R. Wildemuth; "New membrane process debottlenecks solvent dewaxing unit," Oil and Gas Journal, 97/46, 67-68, 70, 72-24 (1999 1115). Abstract.

Jiao-Li Li, Xu-Xiang Li, Bing-Hua Ni; "Development of ultrafiltration and its application in recovery of dewaxing solvent," Shihua Jishu Yu Yingyong (2000), 18(5), 295-297, 301. Abstract.

S. Elmaleh, N. Ghaffor; "Upgrading oil refinery effluents by cross-flow ultrafiltration," Water Science & Technology, 34(9), 231-238 (1996), Aqualine Abstracts Abstr. No. 97-4463 V13 N.9 (Sep. 1997). Abstract.

B. Park, V. S. Ravi-Kumar, T. T. Tsotsis; "Models and simulation of liquid—phase membrane reactors," Industrial & Engineering Chemistry Research, V37 N. 4, 1276-89 (Apr. 1998). Abstract.

A. Duong, K. J. Smith; "A model of ceramic membrane fouling during heavy oil," Canadian Journal of Chemical Engineering, V75 N. 6, 1122-29 (Dec. 1997). Abstract.

M. Garcia Sanchez, J. L. Perez Pavon, B. Moreno Cordero; J. Chromatogr., A, 766 (1+2), 61-69 (1997) Chemical Abstracts Abstr. No. 319181 V126 N. 24. Abstract.
V. S. Ravi-Kumar, T. T. Tsotsis, M. Sahimi; "Studies of the transport of asphaltenes through membranes using hindered diffusion theories for spheres and spheroids," Industrial & Engineering Chemistry Research, V36 N. 8, 3154-62 (Aug. 1997). Abstract.
V. S. Ravi-Kumar, L. Yang, T. T. Tsotsis; "Liquid-phase reactive applications with inorganic membranes : Models and experiments," ACS 214$^{th}$ National Meeting (Las Vegas Sep. 7-11, 1997) Book of Abstracts Part 2 Abstr. No. PMSE-273 (1997). Abstract.
A. Duong, G. Chattopadhyaya, W. Y. Kwok, K. J. Smith; "An experimental study [using Cold Lake (Alberta) oil] of heavy oil ultrafiltration using [single-tube] ceramic membranes," Fuel, V76, N. 9, 821-28 (Jul. 1997). Abstract.
S. Elmaleh, N. Ghaffor; "Upgrading oil refinery effluents by cross-flow ultrafiltration," Water Sci. Technol., 34(9), Water Quality International '96 Part (2), 231-238 (1996) Chemical Abstracts Abstr. No. 79315, V126 N. 6. Abstract.
E. Beaver, Siegel; Technologies critical to a changing world / Clean technologies), AIChE et al. 5$^{th}$ World Chemical Engineering Congress (San Diego Jul. 14-18, 1996) Summary Proceedings 100-03, 159-61 (Oct. 1996). Abstract.
W. Ying, B. Tansel; "Effect of coagulation on fouling rate and cleanability of ultrafiltration membranes," Purdue University 50$^{th}$ Industrial Waste Conference (West Lafayette, IN May 8-10, 1996) Proceedings 285-95 (1995). Abstract.
J. L. Humphrey; "Separation processes: Playing a critical role," Chemical Engineering Progress, V91, N. 10, 31-41 (Oct. 1995). Abstract.
V. N. Zrelov, N. G. Postnikova, L. V. Krasnaya; "Rapid membrane (diffusion) methods for determining mechanical impurities in liquid petroleum products," Khimiya I Tekhnologiya Topliv i Masel, N. 4, 28-30 (1994). Abstract.
B. D. Sparks, J. D. Hazlett, O. Kutowy, T. A. Tweddle, Union Carbide Corp.; "Upgrading of solvent extracted Athabasca bitumen by membrane ultrafiltration," AIChE Journal V36, N. 8, 1279-82 (Aug. 1990). Abstract.
R. J. Torres-Ordonez, S. G. Kukes, F. S. Lee, D. C. Cronauer; "Characterization of solids from coal/resid(ue) coprocessing," ACS 200$^{th}$ National Meeting (Washington, DC Aug. 26-31, 1990) ACS Division of Fuel Chemistry Preprints V35 N.4, 1048-55 (1990). Abstract.
J. D. Hazlett, O. Kutowy, T. A. Tweddle, B. A.Farnand; "Processing of Crude Oils with Polymeric Ultrafiltration Membranes," Nat'l. Res. Counc. Can.; Can. Cent. Miner. Energy Technol, 1989 AIChE Spring Nat'l Meeting (Houston Apr. 2-6, 1989), Prepr. N. 64f 18P.
B. D. Sparks, J. D. Hazlett, O. Kutowy, T. A. Tweddle; "Upgrading of solvent extracted Athabasca bitumen by Membrane ultrafiltration," AIChE 1987 Summer Natl. Meet. (Minneapolis 816-19/87 Prepr. N. 7D 22P. Abstract.
M. Nishimura; "Application and development of membrane separation processes in oil chemistry and its related fields," Yakagaku, 34(3), 171-7 (1985), Chem. Abstr. Abstr. No. 168846 V102 N. 20. Abstract.
D. S. Schuster, C. A. Irani; "Understanding the pour point depression mechanism -2, microfiltration analysis of crude oils," 189$^{th}$ ACS Natl. Meet. (Miami Beach Apr. 28-May 3, 1985) ACS Div. Fuel Chem. Prepr. V30 N.1, 169-77 (1985). Abstract.
J. Durandet; "Separation (Processes) in the refining industry/introduction separations dans le raffinage/introduction," Pet. Tech. N.298 5-6 (May 1983). Abstract.
J. Briant, G. Hotier; "The state of asphaltenes in hydrocarbon mixtures the size of molecular clusters," Rev. Inst. Fr. Pet. V38 N.1 83-100 (Jan.-Feb. 1983). Abstract.
D. Defives, R. Avrillon, C. Miniscloux, R. Roullet, X. Marze; "Regeneration of used lubricating oils by ultrafiltration," Informations Chimie (1978), 175, 127-31. Abstract.
A. Duong, K. Smith, JCS University of British Columbia; Canadian Journal of Chemical Engineering V75 N. 6, 1122-29 (Dec. 1997). Abstract.
V. N. Zrelov, N. G. Postnikova, L. V. Krasnaya; "Analytical filtration of petroleum and synthetic products through membranes," Khim. Tekhnol. Topl. Masel (1984), (11), 32-4. Abstract.
R. J. Thrash, R. H. Pildes; "The diffusion of Petroleum asphaltenes (from a Middle East high-sulfur vacuum residuum) through well characterized (MICA) porous membranes," 181$^{st}$ ACS Natl. Meet (Atlanta Mar. 29-Apr. 3, 1981) ACT Div. Pet. Chem. Prepr. V26 N.2515-25 (Mar. 1981). Abstract.
D. D. Spatz; "Ultrafiltration . . . The membranes, the process, and its application to organic molecule fractionation (Including industrial oil/water separations," 178$^{th}$ ACS Natl. Meet. (Washington, DC Sep. 9-14, 1979) Abstr. Pap. Abstr No. COLL-125. Abstract.
G. Sartori, W. S. Ho, R. E. Noone, B. H. Ballinger; "(New) poly(fluoroolefin) membranes for aromatics/saturates separation," AIChE 1997 Annual Meeting (Los Angeles Nov. 16-21, 1997) Preprint N.32d 6P. Abstract.
V. S. Ravi-Kumar, I. A. Webster, T. T. Tsotsis, R. C. Sane, M. Sahimi; "Studies of diffusion of petroleum liquid macromolecules through model membranes," AIChE 1992 Annual Meeting (Miami Beach Nov. 1-5, 1992) Preprint N.22g 3P. Abstract.
R. C. Sane, I. A. Webster, T. T. Tsotsis, V. S. Ravi-Kumar; "Studies of asphaltene diffusion and structure and their implications for resid(uum) upgrading," 12$^{th}$ International "Chemical Reaction Engineering Today" Symposium (Turin, Italy Jun. 28-Jul. 1, 1992) Chemical Engineering Science V47 N.9-11 2683-88 (Jun.-Aug. 1992). Abstract.
R.C. Sane; "The diffusion of petroleum asphaltenes in porous membranes," University of Southern California, Dissertation (1991) (Abstract) Dissertation Abstracts International: Section B Science & Engineering V52 N.8 4350-B (Feb. 1992). Abstract.
Yong Woo Rho, Hwayong Kim, Won Hee Park; "Effect of oil viscosity on ultrafiltration flux," Hwahak Konghak (1989), 27(4), 446-50. Abstract.
Yujun Song, Fuan Liu, Yong Yang, Jian Zou, Benhui Sun, Tianyuan Zhong; "Review on the preparation and application of nanofiltration membrane," Huangong Keji (1999), 7(3), 1-7. Abstract.
May-Britt Haag; "Membranes in chemical processing. A review of applications and novel developments," Separation and Purification Methods (1998), 27(1), 51-168. Abstract.
H. Zuern, K. Kohlhase,K. Hedden, J. Weitkamp; "Developments in refinery technology-1. Process technology, processing of crudes, residua, and heavy oils,"50$^{th}$ DGMK Anniv. Meet (Berline Nov. 24-26, 1983) Erdoel Kohle, Erdgas, Petrochem. Brennst. Chem. V37 N.2 52-69 (Feb. 1984). Abstract.
R.E. Baltus, J.L. Anderson; "Hindered diffusion of asphaltenes through microporous membranres," Chemical Engineering Science (1983), 38(12) 1959-69. Abstract.
A. Duong, K. J. Smith; "A model of ceramic membrane fouling duringheavy oil ultrafiltration," Canadian Journal of Chemical Engineering V75 N.6 1122-29 (Dec. 1997). Abstract.

* cited by examiner

DEASPHALTER UNIT THROUGHPUT INCREASE VIA RESID MEMBRANE FEED PREPARATION

This application claims the benefit of U.S. Provisional Application No. 60/966,474 filed Aug. 28, 2007.

FIELD OF THE INVENTION

This invention relates to a process of improving a deasphalting unit process by producing an improved feedstream for the deasphalting process via ultrafiltration of a vacuum resid-containing feedstream. The improved permeate product from the ultrafiltration process can be utilized to improve the product quality of and/or increase the production volume of a deasphalted oil from a solvent deasphalting unit.

BACKGROUND OF THE INVENTION

Solvent deasphalting of heavy residual hydrocarbon containing feedstocks such as vacuum and atmospheric resids is well known in the art and extensively used in modern petroleum and petrochemical processing of crude oils and other raw petroleum refining feedstocks. As the need for processing lower grade feedstocks with lower API gravities and higher viscosities in existing and new petroleum refining facilities increases, the increase on petroleum resid content and overall residual production continues to require improved and/or larger facilities for subsequent treatment of these residual intermediate products produced.

The refining residual products, including atmospheric and vacuum resids, have high boiling point ranges, with initial boiling points ranging from about 650° F. (343° C.) to over 1000° F. (538° C.), as well as high density, viscosity, and asphaltene metal contents. For many refinery processes, a significant amount of the high molecular weight multi-ring asphaltene components must be removed from these residual streams prior to further processing these streams into higher value products. Solvent deasphalting processes such as Propane Deasphalting (PDA), Solvent Deasphalting (SDA), and Residual Oil Solvent Deasphalting (ROSE) are well known in the art. All of these processes use low boiling-point, alkane-based solvents to precipitate the asphaltenes from the resid/solvent mixture and to remove a higher asphaltene content product stream as well as a lower asphaltene content oil/solvent stream. It should be noted that the term solvent deasphalting used herein, pertains to any extraction deasphalting process that utilizes an alkane-based solvent for the extraction of asphaltenes. The lower boiling point solvent is recovered from the low asphaltene content oil/solvent stream to produce a deasphalted oil ("DAO") with reduced asphaltene content. Depending upon the specifications for the solvent deasphalting process, the DAO product produced is of a reduced asphaltene sufficient to be utilized as a feedstock to subsequent refinery upgrading processes. The DAO product thus produced is generally of sufficient quality to be sent for further processing in refining catalytic upgrading units, but the DAO product is most commonly utilized in the production of lubrication oil grade products.

Several patents exist to improve the solvent deasphalting processes. U.S. Pat. No. 3,929,616 describes a process for solvent extraction of aromatics from a residual oil prior to hydrocracking and solvent deasphalting. U.S. Pat. Nos. 4,592,832 and 5,178,750 describe processes for improving the deasphalting process through a two-step solvent process. Other patents, such as U.S. Pat. No. 6,274,030 have utilized filters to remove solids in conjunction with the solvent deasphalting, but the process does not appreciably change the molecular composition of the hydrocarbon stream produced. U.S. Pat. No. 6,524,469 utilizes a membrane separations process to upgrade a visbroken resid stream prior to solvent deasphalting. However, all of these processes require either additional available capacity in the solvent deasphalting unit and/or the use of additional solvents, in particular valuable low boiling point alkane-based solvents, for the pre-treatment of the heavy oil stream prior to the solvent deasphalting process.

There are many problems that exist in the industry subject to the need for improved deasphalting processes. Firstly, conventional solvent deasphalting processes are expensive to install and operate. They require a significant amount of process equipment and require the use of valuable hydrocarbon based solvents which can be lost in the processing of the residual oils, as well as a significant amount of energy expenditures in order to fractionate and recover the solvent components from the deasphalted oil components. Additionally, refineries in the U.S. as well as many other countries are aging and struggling to maintain or increase capacity while the demand to utilize raw petroleum feedstocks with higher residual contents is increasing. Existing solvent deasphalting units can be difficult to upgrade especially if the deasphalting units are hydraulically limited. In this case, the equipment is too small for the required production rates, and expensive equipment replacement or modifications can be prohibitive in costs. Thirdly, as the demand for more and higher quality lube oil products increases, existing solvent deasphalting units are faced with need to produce both a higher quality product as well as an increase in production. As stated, today's petroleum refiner is faced with very costly modifications to existing deasphalting units to meet these increased quality and production volume demands.

Therefore, there is a need in the industry for an improved integrated deasphalting process. An even greater need exists for a process which can improve the product quality and production throughput of DAO from existing solvent deasphalting units while utilizing equipment which can be operated in conjunction with existing deasphalting processes, and which do not require significant equipment replacements or modifications to an existing deasphalting unit.

SUMMARY OF THE INVENTION

The present invention relates to a process of improving a deasphalting unit process by producing an improved feedstream for the deasphalting process via ultrafiltration of a vacuum resid containing feedstream. In particular, the present invention results in an improved quality feedstream to a solvent deasphalting process which results in improved deasphalted oil ("DAO") production rates and/or higher quality deasphalted oils. This invention can be particularly beneficial when used in conjunction with an existing deasphalting equipment to result in improved DAO production rates and/or higher quality deasphalted oils from the existing deasphalting equipment without the need for significant equipment modifications to the existing deasphalting unit.

One embodiment of the present invention is a solvent deasphalting process, comprising:

a) conducting an atmospheric resid to a vacuum distillation tower;

b) retrieving a vacuum resid stream from the vacuum distillation tower;

c) conducting a vacuum resid-containing stream comprised of at least a portion of the vacuum resid stream to a membrane separations unit wherein the vacuum resid-containing stream contacts a first side of at least one porous membrane element;

d) retrieving a permeate product stream from the second side of the porous membrane element, wherein the permeate product stream is comprised of selective materials which pass through the porous membrane element from the first side of the porous membrane element to the second side of the porous membrane element;

e) retrieving a retentate product stream from the first side of the porous membrane element;

f) conducting at least a portion of the permeate product stream to a solvent deasphalting unit; and g) retrieving a deasphalted oil product stream from the solvent deasphalting unit;

wherein the CCR wt % content of the permeate product stream is at least 20% lower than the CCR wt % content of the vacuum resid-containing stream, and the deasphalted oil product stream has a lower asphaltene wt % than said permeate product stream.

In yet another embodiment, the porous membrane element has an average pore size of about 0.001 to about 2 microns. In still another embodiment, the vacuum resid-containing stream is conducted to the membrane separations unit at a temperature from about 212 to about 662° F. (100 to 350° C.). In an embodiment, the transmembrane pressure across the porous membrane element is greater than about 250 psi and the absolute viscosity (in centipoise at 100° C.) of the permeate product stream is at least 250 centipoise lower than the absolute viscosity (in centipoise at 100° C.) of vacuum resid-containing stream.

Another embodiment of the present invention is a lubes bright stock production process, comprising:

a) conducting an atmospheric resid to a vacuum distillation tower;

b) retrieving a vacuum resid stream from the vacuum distillation tower;

c) conducting a vacuum resid-containing stream comprised of at least a portion of the vacuum resid stream to a membrane separations unit wherein the vacuum resid-containing stream contacts a first side of at least one porous membrane element;

d) retrieving a permeate product stream from the second side of the porous membrane element, wherein the permeate product stream is comprised of selective materials which pass through the porous membrane element from the first side of the porous membrane element to the second side of the porous membrane element;

e) retrieving a retentate product stream from the first side of the porous membrane element;

f) conducting at least a portion of the permeate product stream to a solvent deasphalting unit;

g) retrieving a deasphalted oil product stream from the solvent deasphalting unit;

h) conducting at least a portion of the deasphalted oil product stream to a lubes extraction unit wherein a low-aromatics lube extraction unit product stream is produced;

i) conducting at least a portion of the low-aromatics lube extraction unit product stream to a dewaxing process;

j) retrieving a lubes bright stock product stream from the dewaxing process; and k) blending at least a portion of the lubes bright stock product stream into a final lubrication oil product;

wherein the CCR wt % content of the permeate product stream is at least 20% lower than the CCR wt % content of the vacuum resid-containing stream, and the deasphalted oil product stream has a lower asphaltene wt % than said permeate product stream.

DETAILED DESCRIPTION OF THE PREFERRED EMBODIMENTS

A preferred embodiment of the present invention is a process for upgrading a residual feedstream comprised of a vacuum resid stream by subjecting the residual feedstream to an ultrafiltration process and utilizing the permeate product thus produced as a feedstream to a solvent deasphalting process. Although specific solvent deasphalting processes may be referred to as Propane Deasphalting (PDA), Solvent Deasphalting (SDA), Residual Oil Solvent Deasphalting (ROSE), it should be noted that the term "solvent deasphalting" used herein, refers to these specific deasphalting processes as well as any extraction based deasphalting process for the extraction of asphaltenes from a hydrocarbon stream. A few additional terms as utilized herein are defined as follows.

The "Micro Carbon Residue" (or "MCR") as used herein is a measure of carbon content of a sample as measured per test method ASTM D4530. The terms "Micro Carbon Residue" ("MCR") and "Conradson Carbon Residue" ("CCR") are considered as equivalent values as used herein and these terms are utilized interchangeably herein.

The term "average boiling point" as used herein is defined as the mass weighted average boiling point of the molecules in a mixture. This may be determined by simulated distillation gas chromatography. The term "initial boiling point" as used herein is defined as the temperature at which 5 wt % of the mixture is volatized at atmospheric (standard) pressure. The term "final boiling point" as used herein is defined as the temperature at which 95 wt % of the mixture is volatized at atmospheric (standard) pressure.

The term "transmembrane pressure" as used herein is defined as the difference in pressure as measured across a membrane element being the difference in pressure between the higher pressure feed/retentate side of a membrane element and the lower pressure permeate side of the membrane element.

Figure 1:
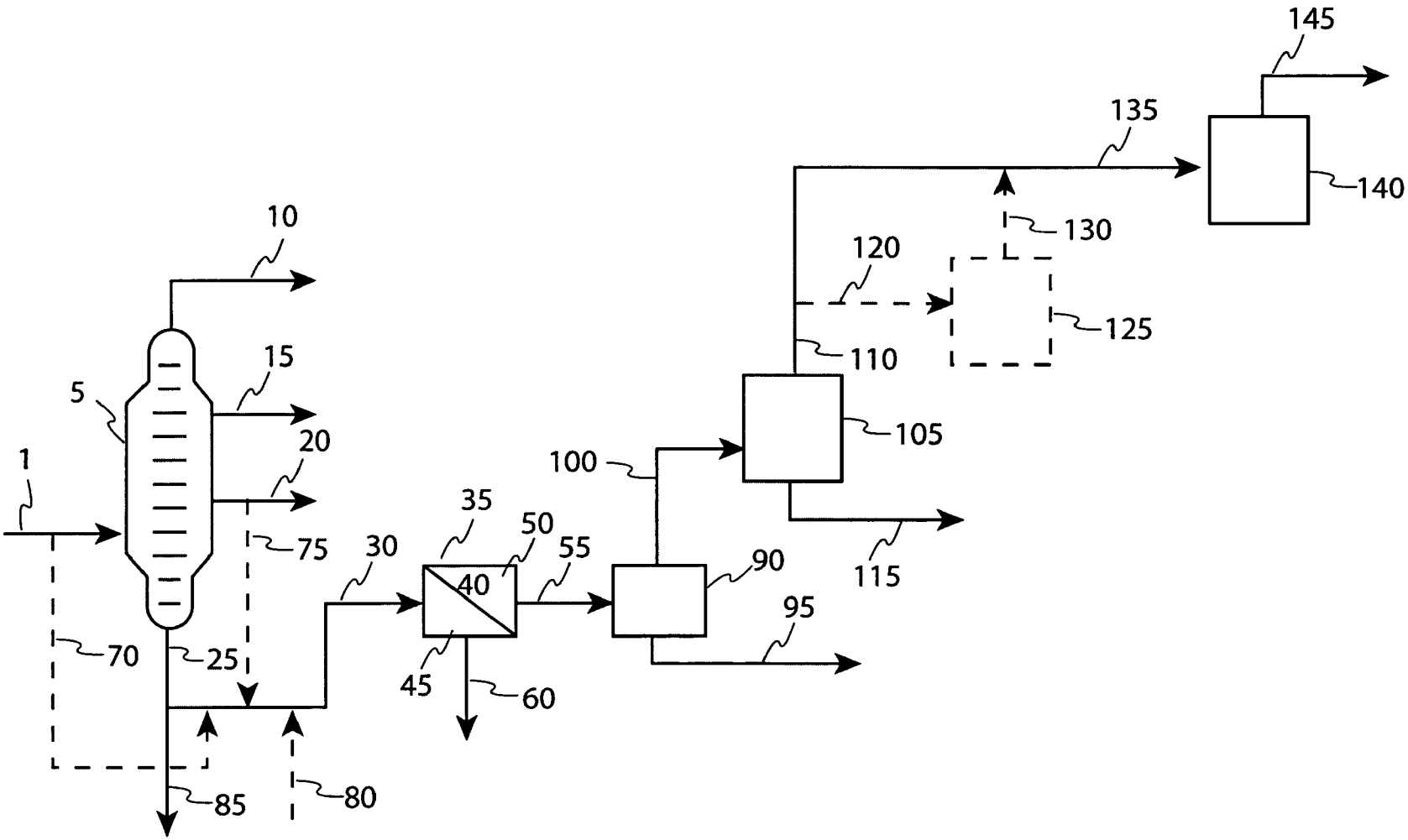
FIG. 1 hereof illustrates an embodiment of the current invention wherein a vacuum resid-containing stream is upgraded in an ultrafiltration process for improved production of a deasphalted oil for use in the production of a lubricating oil product.

FIG. 1 herein illustrates a preferred configuration of the resid upgrading and solvent deasphalting process of the present invention. In this process, an atmospheric resid stream (1) is fed to a vacuum distillation column at elevated temperatures. The atmospheric resid stream is comprised of the resid or bottoms product from a crude unit atmospheric distillation column and preferably, the atmospheric resid stream is heated to about 700 to about 850° F. (371 to 455° C.) prior to entering the vacuum distillation column (5). In the vacuum distillation column, the atmospheric resid stream is separated into various boiling point range streams under a partial to near full vacuum pressure. The vacuum distillation column is preferably run at an overhead vacuum pressure from about 0 to about 7.5 psia, more preferably from about 0.5 to about 3 psia. The non-condensable gases and lightest hydrocarbon fractions (10) are removed from the top or "overhead" portion of the vacuum tower usually through a series of vacuum eductors which are utilized to maintain the tower at sub-atmospheric pressures.

Many heavier hydrocarbon fractionations are also obtained from the vacuum distillation tower. For simplicity reasons, FIG. 1 shows only three other common streams drawn from the vacuum distillation although in actual practice there may be additional fractionation cuts from the vacuum distillation tower (5). A light vacuum gas oil, or "LVGO" stream (15) can be taken from the vacuum distillation tower and has a nominal boiling range from about 550 to about 830° F. (288 to 443° C.). A heavy vacuum gas oil, or "HVGO" stream (20) is also normally drawn from the vacuum distillation tower and has a nominal boiling range from about 750 to about 1050° F. (399 to 566° C.). The majority of the higher boiling point materials are drawn off from the bottom portion of the vacuum distillation tower as a vacuum resid stream (25). The vacuum resid usually contains the heaviest fractionation cuts generally with an initial boiling point of about 850° F. (454° C.) to over 1000° F. (538° C.).

In addition to high boiling-point hydrocarbons, the vacuum resid stream is comprised of a significant percentage of high molecular weight multi-ring asphaltenes, as well as typical hydrocarbon stream contaminants such as metals (e.g., iron, nickel, and vanadium) which can be detrimental especially to downstream catalytic processes and other product contaminants such as sulfur. In a typical vacuum distillation process for lubes production, the vacuum resid stream (25), or a portion thereof, would typically be sent directly to a solvent deasphalting unit for removal of asphaltenes from the steam to produce a deasphalted oil (DAO). The asphaltenes present in the vacuum resid stream, being of high viscosity and high aromatics content, are not suitable for lube oil production and can also contain significant amounts of metal and sulfur heteroatoms which do not meet the necessary specifications for lube oil production. A significant portion of the asphaltenes, as well as a portion of the metal and sulfur contaminants therein, is removed in a typical solvent deasphalting process.

Returning to FIG. 1, in a preferred embodiment of the present invention, at least a portion of the vacuum resid stream (25) is sent to a membrane separations unit (35). However, in other preferred embodiments, a portion of the atmospheric resid stream (70), a portion of the heavy vacuum gas oil stream (75), and/or a fluxant stream (80) with a lower average boiling point than the vacuum resid stream (25) can be added to the vacuum resid stream (25) to form a vacuum resid-containing stream (30) prior to processing in the membrane separations unit (35). In a preferred embodiment, if a fluxant stream is utilized, it is preferred that the average boiling point of the fluxant stream is from about 300 to about 800° F. (149 to 427° C.), even more preferably from about 350 to about 700° F. (177 to 371° C.). However, it is preferred that the vacuum resid-containing stream (30) is comprised of greater than 50 vol % vacuum resid, even more preferably comprised of greater than 75 vol % vacuum resid, and most preferably comprised of greater than 85 vol % vacuum resid. In a preferred embodiment, the vacuum resid-containing stream has a final boiling point of at least 1100° F. (593° C.). The remaining portion of the vacuum resid stream (85), or a portion thereof, can be sent for further processing in refinery processes such as, but not limited to, a delayed coking unit, a fluid coking unit or an asphalt unit.

The vacuum resid-containing stream (30) is processed in a membrane separations unit (35) which wherein the membrane separations unit is comprised of at least one membrane (40), a retentate zone (45) wherein the membrane feedstream contacts a first side of at least one permeable membrane, and a permeate zone (50) wherein a permeate product stream (55) is obtained from the opposite or second side of the membrane. The permeate product stream (55) is comprised of selective materials that permeate through the membrane (40). The retentate product stream (60) leaves the retentate zone (45), deplete of the extracted permeated components, and the permeate product stream (55) leaves the permeate zone (50) for further processing in a solvent deasphalting unit (90).

In a preferred embodiment of the present invention, at least one membrane has an average pore size of about 0.001 to about 2 microns (μm), more preferably about 0.002 to about 1 micron, and even more preferably about 0.004 to about 0.1 microns. It is also preferred that the membranes utilized in the present invention be constructed of such materials and designed so as to withstand prolonged operation at elevated temperatures and transmembrane pressures. In one embodiment of the present invention the membrane is comprised of a material selected from a ceramic, a metal, a glass, a polymer, or combinations thereof. In another embodiment, the membrane is comprised of a material selected from a ceramic, a metal, or combination of ceramic and metal materials. Particular polymers that may be useful in embodiments of the present invention are polymers comprised of polyimides, polyamides, and/or polytetrafluoroethylene provided that the membrane material chosen is sufficiently stable at the operating temperature of the separations process.

In a preferred embodiment of the present invention, the temperature of vacuum resid-containing stream (30) prior to contacting the membrane system is at a temperature of about 212 to about 662° F. (100 to about 350° C.), more preferably from about 212 to about 572° F. (100 to about 300° C.), and even more preferably from about 302 to about 482° F. (150 to about 250° C.). The transmembrane pressure may vary considerably depending on the selectivity and the flux rates that are desired, but in preferred embodiments, the transmembrane pressure as defined above is greater than about 100 psig, more preferably greater than about 250 psig, even more preferably greater than about 500 psig, even more preferably greater than about 750 psig, and most preferably greater than about 1000 psig.

In an embodiment, the heavy hydrocarbon feedstream is flowed across the face of the membrane element(s) in a "cross-flow" configuration. In this embodiment, in the retentate zone, the heavy hydrocarbon feed contacts one end of the membrane element and flows across the membrane, while a retentate product stream is withdrawn from the other end of the retentate zone. As the feedstream/retentate flows across the face of the membrane, a composition selective in saturated compounds content flows through the membrane to the permeate zone wherein it is drawn off as a permeate product stream. In a cross-flow configuration, it is preferable that the Reynolds number in at least one retentate zone of the membrane separations unit be in the turbulent range, preferably above about 2000, and more preferably, above about 4000. In some embodiments, a portion of a retentate stream obtained from the membrane separation units may be recycled and mixed with the feedstream to the membrane separations unit prior to contacting the active membrane.

As can be seen in the examples below, an upgraded permeate product stream may be obtained from a vacuum resid stream, or conversely, a vacuum resid-containing feedstream obtained by combining multiple heavy hydrocarbon component streams as described. The process of the invention can be utilized to obtain a permeate product stream from a vacuum resid-containing feedstream wherein the CCR wt % content of the permeate product stream is at least 20% lower than the CCR wt % content of the vacuum resid-containing feedstream. More preferably the CCR wt % content of the permeate product stream at is at least 35% lower than the CCR wt % content of the vacuum resid-containing feedstream, and even more preferably the CCR wt % content of the permeate product stream is at least 50% lower than the CCR wt % content of the vacuum resid-containing feedstream.

Figure 2:
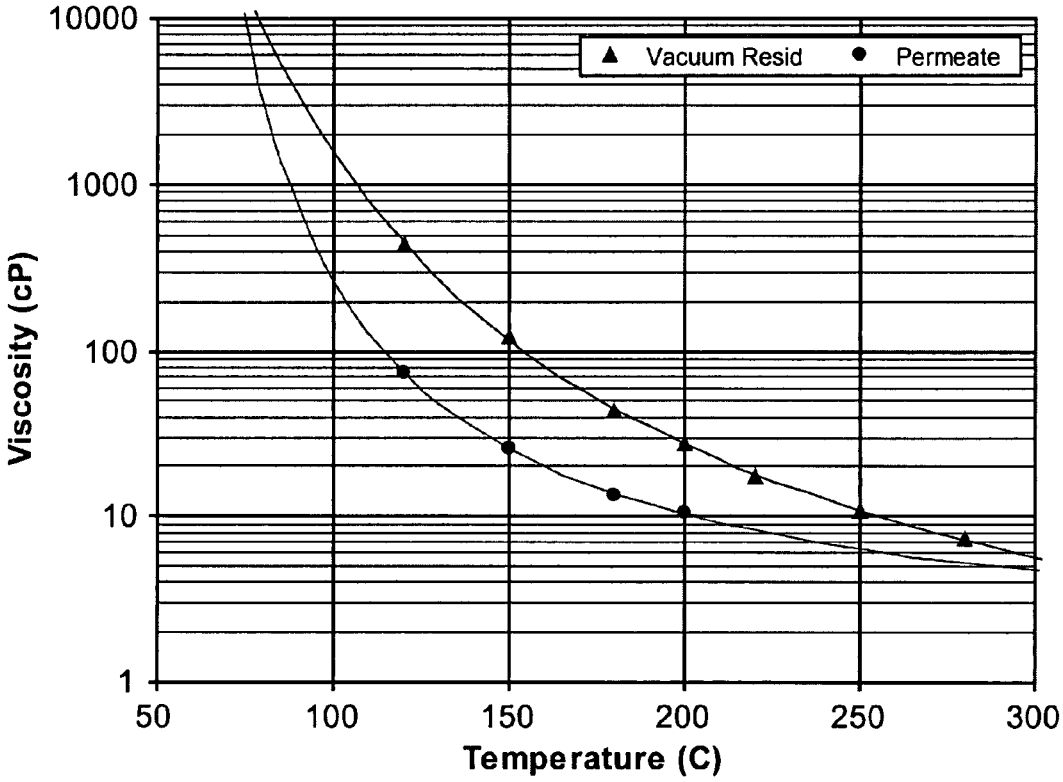
FIG. 2 hereof is a graph of the viscosity versus temperature of a lubes vacuum resid feed and a permeate product obtained from the lubes vacuum resid feed in accordance with one embodiment of the present invention.

As illustrated in Example 3 and shown in FIG. 2, a reduced viscosity permeate stream may be obtained by the present invention for use as a feedstream to the deasphalting process. In a preferred embodiment of the present invention, the absolute viscosity (in centipoise at 100° C.) of the permeate product from the separations process is at least 250 centipoise lower than the absolute viscosity (in centipoise at 100° C.) of the vacuum resid-containing feedstream to the separations process. In other embodiments, the absolute viscosity (in centipoise at 100° C.) of the permeate product from the separations process is at least 500 centipoise lower, and more preferably at least 750 centipoise lower than the absolute viscosity (in centipoise at 100° C.) of the vacuum resid-containing feedstream to the separations process.

The permeate product stream thus obtained is of sufficiently low CCR content and possessing a sufficiently reduced viscosity as compared to the initial feed to allow an increased rate of the permeate product stream to be processed in a solvent deasphalting unit than the rate of vacuum resid-containing feedstream that could be processed in the same solvent deasphalting unit while obtaining a similar CCR content in the deasphalted oil products. It should be noted that the terms Conradson Carbon Residue ("CCR") and Micro Carbon Residue ("MCR") are considered as equivalents herein and these terms are utilized interchangeably herein.

In a preferred embodiment, the present invention results in a yield rate of deasphalted oil product that is at least 10% greater than the yield rate of deasphalted oil product that would be produced by the vacuum resid-containing feedstream. More preferably, the yield rate of deasphalted oil product produced will be 20% greater, more preferably 35% greater, and even more preferably 50% greater than the yield rate of deasphalted oil product that would be produced by the vacuum resid-containing feedstream. Additionally, since only a portion of the overall resid stream needs to be processed in the deasphalting unit, the overall resid separation capacity of the current process is significantly increased over an existing or equivalent size solvent deasphalter. The Examples herein further illustrate the processing improvements of the present invention.

Returning to FIG. 1, in the solvent deasphalting unit (90), the permeate product stream (55) is mixed with a low boiling-point alkane-containing solvent material. Preferably, the alkane-containing solvent material is comprised of a $C_2$ to $C_8$ alkane, and even more preferably comprised of a normal alkane. Most preferred are solvent materials comprised of propane, n-butane, or n-pentane.

In the solvent deasphalting unit, asphaltenes precipitate from the solvent/asphaltene containing mixture and an asphaltene rich stream with some solvent is removed from the deasphalting unit. After the solvent has been removed, an asphaltene-rich deasphalter product stream (95) is produced. In a preferred embodiment, this asphaltene-rich deasphalter product stream is sent to a thermal cracking unit for further processing. In a more preferred embodiment, this stream is sent to either a thermal coking unit, including, but not limited to, a delayed coking unit, a Fluid Coking unit, or a Flexicoking unit. In an even another preferred embodiment, the asphaltene-rich deasphalter product stream is used as a blendstock for road or other asphalt products.

A Deasphalted Oil ("DAO")/solvent mixture is produced in the deasphalting unit (90). The solvent is separated from the DAO in the deasphalting unit by heating the combined stream and fractionating off the low molecular weight solvent. The DAO stream (100) thus produced has a significantly lower asphaltene content than the permeate product stream produced by the process of the present invention. The DAO is a high-quality feedstream for the production of lubrication oils. In a preferred embodiment of this invention, the DAO stream (100) is sent to a process selected from a lubes extraction unit, a lubes hydrofinishing unit, a lubes catalytic dewaxing unit, and/or a lubes chilled dewaxing unit for the production of a lubes bright stock material.

In a preferred embodiment, as shown in FIG. 1, at least a portion of the DAO stream (100) is sent to a lubes extraction unit ("LEU") (105). In the LEU, a solvent material such as, but not limited to, furfural, N-methyl-2-pyrrolidone or phenol, is utilized to extract a portion of the undesired aromatics from the DAO stream (100) to the LEU (105). This process produces a low-aromatics LEU product stream (110) which has an increased overall saturates content over the DAO stream to the LEU. This reduction of aromatics content in the LEU product stream results in an improved viscosity index of the final lubricating oil feedstock. The higher-aromatics content stream (115) extracted from the DAO stream in the LEU can be sent for further refinery processing.

An additional benefit of the present invention is that a significant improvement in the saturates content of the permeate product stream produced in the membrane separation unit (35) may be obtained from the vacuum resid. This higher saturates content/lower aromatics content of the permeate product stream of the present invention also contributes to improving the viscosity index of the final lubricating oil feedstock. Tables 1 and 2 in Examples 1 and 2 show the improvements in saturate content obtained through the use of the present invention. This saturates increase in turn can result in an improved quality final bright stock product and/or can reduce the amount of solvent extraction required in the overall process.

Continuing with FIG. 1, the low-aromatics LEU product stream (110), or a portion thereof, can optionally be sent via line (120) for further processing in a lubes hydrofinishing unit ("LHU") (125). Alternatively, depending on the composition of the lubrication feedstocks, equipment configurations, and product specifications, the low-aromatics LEU product stream (110) obtained from the present invention may be of sufficient quality to send directly to a lubes dewaxing unit (140). In the LHU (125), the low-aromatics LEU product stream (110) is subjected to hydrogen and a catalyst to improve the saturates content of the feedstream thereby producing a hydrofinished lubes stream (130). The improved saturates content produced in the permeate product stream (55) by the present invention can reduce the amount of hydrogen consumed in the LHU process as well as improve the overall saturates content of the hydrofinished lubes stream.

In a preferred embodiment, the low aromatics LEU product stream (110), the hydrofinished lubes stream (130), or a combination of these streams is sent via line (135) for further processing to remove the high molecular-weight paraffinic materials (or "wax"). Two preferred processes for the removal of wax molecules from the hydrocarbon stream are catalyst dewaxing processes and chilled dewaxing processes. In the catalytic dewaxing process, the intermediate lubes feedstream, which is comprised of either the low aromatics LEU product stream or the low-aromatics LHU product stream or a combination thereof, is contacted with a catalytic dewaxing catalyst in the presence of a hydrogen gas. This process is designed to selectively crack and/or isomerize and hydrogenate the high molecular-weight paraffinic "wax" molecules to produce lower molecular-weight saturated hydrocarbons. It is desired in this process to minimize the cracking reactions of the lube grade components in the process stream. One benefit of the catalytic dewaxing process is that most of the wax grade hydrocarbon materials in the process stream are converted into lower molecular weight hydrocarbons. Conversely, in the chilled dewaxing process, the intermediate lubes feedstream, is subjected to a process whereby the stream is subjected to a refrigeration process, usually utilizing propane as a refrigerant, to a temperature wherein the wax molecules precipitate out of the intermediate lubes feedstream and are subsequently mechanically removed from the feedstream in the processing. The chilled dewaxing process has the benefit of producing a paraffin wax which is a high value commodity, but in contrast to the catalytic dewaxing process, the chilled dewaxing process is very equipment intensive and does not convert the wax components into high value lubrication oil components. Regardless of the dewaxing process utilized in the process of the current invention (i.e., the catalytic dewaxing process or the chilled dewaxing process) a lubes "bright stock" product stream (145) is produced which is of sufficient quality to be utilized as a blend component in lubricating oils production.

As can be seen in the examples below, the present invention results in improved production rates for solvent deasphalting processes thus improving the amount of vacuum resid that can be processed with a given solvent deasphalting unit as well as increasing the lubrication oils bright stock quantity and/or quality that can be produced from existing solvent deasphalting equipment.

The Examples below further illustrate the improved product qualities and production rates that can be achieved through the use of specific embodiments of the present invention.

EXAMPLES

Example 1

In this Example, a lubes vacuum resid was permeated in a batch membrane process using an 8 kD (kiloDalton) ceramic nanofiltration membrane. The pore size of this membrane was estimated to be in the 5 to 10 nanometer range. The transmembrane pressure was held at 1000 psig and the feed temperature was held at 200° C. The flux rates as well as the feed, permeates and retentate wt % Micro Carbon Residue ("MCR") values are shown in Table 1. The weight percentages of saturates, aromatics, resins, and polars for the feed, permeates and retentate from the experiment are also tabulated in Table 1. The feed was analyzed at the beginning and the end of the test cycle for wt % MCR per test method ASTM D4530 as well as analyzed for weight content of saturate, aromatic, resin, and polar compounds. The permeate samples taken at given intervals and select permeate samples were also tested for wt % MCR as well as analyzed for weight percentages of saturates, aromatics, resins, and polars content.

As can be seen from Table 1, the permeate obtained from the lubes vacuum resid feed (designated as "initial feed" in Table 1) was significantly reduced in MCR (or equivalent "CCR") content. As can be seen in the data of Table 1, the permeate obtained had MCR content values ranging from about 7.7 to about 9.8 wt % MCR as compared with the lubes vacuum resid feed which had about 18.6 wt % MCR. It can be seen from Table 1 that in preferred embodiments of the present invention, the CCR wt % content of the permeate product stream is at least 40% lower than the CCR wt % content of the lubes vacuum resid feedstream. It can be seen that in the beginning of the cycle the reduction was even greater. These first permeate samples are a more accurate representation of the actual CCR reduction in the permeates obtained as since the test was performed in a batch feed mode, the actual feed composition was increasing in CCR content as subsequent permeate samples were being drawn. It can be seen in Permeate Samples 1 through 3, that the CCR wt % content of the permeate product stream is at least 50% lower than the CCR wt % content of the lubes vacuum resid feedstream in preferred embodiments of the present invention.

TABLE 1

| Sample | Transmembrane Pressure (psi) | Feedstream Temperature (° C.) | Permeate Flux Rate (gal/ft$^2$/day) | Permeate Yield, Cumulative (% of feed) | MCR (wt %) | % Reduction of MCR (compared to the feed) | % Reduction of MCR (compared to the retentate) | Saturates (wt %) | Aromatics (wt %) | Resins (wt %) | Polars (wt %) |
|---|---|---|---|---|---|---|---|---|---|---|---|
| Initial Feed | | | | | 18.6 | | | 7.7 | 63.5 | 16.9 | 11.9 |
| Permeate Sample 1 | 1000 | 200 | 0.45 | 11.1 | 7.9 | 57.5 | | 12.3 | 79.3 | 6.8 | 1.6 |
| Permeate Sample 2 | 1000 | 200 | 0.38 | 14.2 | 7.7 | 58.6 | | 13.0 | 78.9 | 7.3 | 0.9 |
| Permeate Sample 3 | 1000 | 200 | 0.33 | 21.7 | 7.9 | 57.5 | | 11.5 | 81.0 | 6.7 | 0.8 |
| Permeate Sample 4 | 1000 | 200 | 0.30 | 23.1 | — | — | | — | — | — | — |
| Permeate Sample 5 | 1000 | 200 | 0.22 | 38.6 | 8.9 | 52.2 | | 10.6 | 81.1 | 7.5 | 0.8 |
| Permeate Sample 6 | 1000 | 200 | 0.15 | 42.6 | 9.8 | 47.3 | 64.4 | 9.8 | 81.2 | 8.2 | 0.8 |
| Final Retentate | 1000 | 200 | | | 27.5 | | | 2.4 | 59.3 | 17.0 | 21.3 |

It should be noted that the saturates content of the permeate was also significantly increased in the permeate product. As discussed prior, this improved saturates content in the permeate product which is used as a feedstock for further processing lubes processing provides an upgraded intermediate lubes feedstock and can reduce the amount of hydrogen consumed in the lubes hydrofinishing process as well as improve the overall saturates content of the hydrofinished lubes stream. As can be seen from the data in Table 1, the saturates content of lubes vacuum resid feed (designated as "initial feed" in Table 1) was about 7.7 wt %. Permeate Sample 1, 2, and 3 obtained in this example had saturates contents of 12.3 wt %, 13.0 wt %, and 11.5 wt %, respectively. This amounted to a saturates content increase of about 49% to about 68% as compared with the lubes vacuum resid-containing feed. In preferred embodiments of the present invention, the saturates content of the permeate product stream is at least 25% greater than the saturates content of lubes vacuum resid-containing stream. In more preferred embodiments, the saturates content of the permeate product stream is at least 40% greater, and even more preferably at least 50% greater than the saturates content of lubes vacuum resid-containing stream.

Example 2

In this Example, the same lubes vacuum resid was permeated in a batch membrane process utilizing the same type of 8 kD (kiloDalton) ceramic ultrafiltration membrane. The only difference from Example 1 in this example is that the lubes vacuum resid feed temperature was held at 250° C.

Table 2 shows the data from this test example. In general, it can be seen in Table 2 that higher flux rates were obtained in the process at the higher temperature as compared with Example 1 with accompanying generally lower reductions in MCR wt % content in the permeate samples obtained in the process.

Additionally, the effects of feed viscosity and CCR content on a Propane Deasphalter DAO yield were modeled and the correlated effects are presented in Table 3.

TABLE 3

| | Propane Deasphalter Feed Viscosity (centistokes @ 100° C.) | Feed CCR (wt %) | DAO Yield (wt % of feed) |
|---|---|---|---|
| Base Case | 1470 | 20 | 23 |
| | 1470 | 12 | 29 |
| | 1470 | 10 | 30 |
| | 900 | 12 | 35 |
| | 900 | 10 | 37 |
| | 750 | 12 | 36 |
| | 750 | 10 | 39 |
| | 35 | 12 | 42 |
| | 35 | 10 | 43 |

As can be seen in Table 3, the base case of the modeling data of Table 3 corresponds closely to the CCR content of the lubes vacuum resid feed samples of Examples 1 and 2 as well as the viscosity determined from the same lubes vacuum resid sample as shown in FIG. 2 (i.e., approximately 1470 cP @ 100° C. with a specific gravity near 1.0). In FIG. 2, it can be seen that the viscosity of the permeate obtained by the current process was approximately 250 cP at 100° C. It can be seen from the Tables 1 & 2 that the average CCR wt % of the permeates obtained were close to 10 wt % CCR. Interpolating the viscosity and corresponding DAO yield values from Table 3 at a CCR wt % of 10, at 250 cP @ 100° C., the expected DAO yield from the model would be approximately 42% of the lubes vacuum resid feed.

As can be seen in the "Base Case" in Table 3, the expected DAO yield from the untreated lubes vacuum resid would be approximately 23% of the lubes vacuum resid feed. In this example, an estimated 80% increase in DAO yield can be obtained by utilizing the process of the present invention. In preferred embodiments, at least a 40% increase in DAO yield over utilizing a lubes vacuum resid as a feed to the deasphalter unit is obtained by utilizing the permeate product produced by the current invention as the feed to the deasphalter unit. More preferably, the increase in DAO yield is greater than 50% and even more preferably greater than 60% than the DAO yield produced by the lubes vacuum resid in the deasphalter unit. In a preferred embodiment of the present invention, the absolute viscosity (in centipoise at 100° C.) of the

TABLE 2

| Sample | Transmembrane Pressure (psi) | Feedstream Temperature (° C.) | Permeate Flux Rate (gal/ft$^2$/day) | Permeate Yield, Cumulative (% of feed) | MCR (wt %) | % Reduction of MCR (compared to the feed) | % Reduction of MCR (compared to the retentate) | Saturates (wt %) | Aromatics (wt %) | Resins (wt %) | Polars (wt %) |
|---|---|---|---|---|---|---|---|---|---|---|---|
| Initial Feed | | | | | 18.8 | | | 7.7 | 63.5 | 16.9 | 11.9 |
| Permeate Sample 1 | 1000 | 250 | 1.46 | 7.6 | 9.6 | 48.9 | | 14.5 | 75.4 | 8.8 | 1.3 |
| Permeate Sample 2 | 1000 | 250 | 1.07 | 29.7 | 9.8 | 47.9 | | 14.0 | 76.5 | 8.6 | 0.9 |
| Permeate Sample 3 | 1000 | 250 | 0.74 | 35.6 | 10.3 | 45.2 | | 9.5 | 79.7 | 9.7 | 1.2 |
| Permeate Sample 4 | 1000 | 250 | 0.54 | 45.9 | 10.8 | 42.6 | | 9.1 | 81.2 | 8.8 | 1.0 |
| Permeate Sample 5 | 1000 | 250 | 0.40 | 49.0 | 11.4 | 39.4 | 59.9 | 8.6 | 81.2 | 9.3 | 0.9 |
| Final Retentate | 1000 | 250 | | | 28.4 | | | 2.3 | 59.6 | 15.4 | 22.8 |

Example 3

In this Example, both the lubes vacuum resid feed sample as well as the Permeate 4 sample from Example 1, above were measured for their viscosities at various temperatures. The results of the viscosity testing is shown graphically in FIG. 2 herein. It can be seen from FIG. 2, that the permeate obtained had an appreciably reduced viscosity at all temperatures tested.

permeate product from the separations process is at least 250 centipoise lower than the absolute viscosity (in centipoise at 100° C.) of the vacuum resid-containing feedstream to the separations process. In other embodiments, the absolute viscosity (in centipoise at 100° C.) of the permeate product from the separations process is at least 500 centipoise lower, and more preferably at least 750 centipoise lower than the absolute viscosity (in centipoise at 100° C.) of the vacuum resid-containing feedstream to the separations process.

This example shows that the current invention can significantly increase the feed rate and DAO production of an existing deasphalter unit without significant modifications to the deasphalter unit equipment. In a preferred embodiment, the increase DAO results in an increased bright stock stream production for producing high quality lube oil products.

Although the present invention has been described in terms of specific embodiments for better illustration of specific uses and benefits of the invention, it is not so limited. Suitable alterations and modifications for operation under specific conditions will be apparent to those skilled in the art. It is therefore intended that the following claims be interpreted as covering all such alterations and modifications as fall within the true spirit and scope of the invention.

What is claimed is:

1. A solvent deasphalting process, comprising:

a) conducting an atmospheric resid to a vacuum distillation tower;

b) retrieving a vacuum resid stream from the vacuum distillation tower;

c) conducting a vacuum resid-containing stream comprised of at least a portion of the vacuum resid stream to a membrane separations unit wherein the vacuum resid-containing stream contacts a first side of at least one porous membrane element;

d) retrieving a permeate product stream from the second side of the porous membrane element, wherein the permeate product stream is comprised of selective materials which pass through the porous membrane element from the first side of the porous membrane element to the second side of the porous membrane element;

e) retrieving a retentate product stream from the first side of the porous membrane element;

f) conducting at least a portion of the permeate product stream to a solvent deasphalting unit; and g) retrieving a deasphalted oil product stream from the solvent deasphalting unit;

wherein the CCR wt % content of the permeate product stream is at least 20% lower than the CCR wt % content of the vacuum resid-containing stream, and the deasphalted oil product stream has a lower asphaltene wt % than said permeate product stream.

2. The process of claim 1, wherein the porous membrane element has an average pore size of about 0.001 to about 2 microns.

3. The process of claim 2, wherein the vacuum resid-containing stream is conducted to the membrane separations unit at a temperature from about 212 to about 662° F. (100 to 350° C.).

4. The process of claim 3, wherein the transmembrane pressure across the porous membrane element is greater than about 250 psi.

5. The process of claim 4, wherein the absolute viscosity (in centipoise at 100° C.) of the permeate product stream is at least 250 centipoise lower than the absolute viscosity (in centipoise at 100° C.) of vacuum resid-containing stream.

6. The process of claim 4, wherein the vacuum resid-containing stream is comprised of at least 50 wt % vacuum resid.

7. The process of claim 6, wherein the porous membrane element is comprised of a material selected from the group consisting of ceramics, metals, glasses, polymers, and combinations thereof.

8. The process of claim 6, wherein the wt % of saturates in the permeate product stream is at least 25% greater than the wt % of saturates in the lubes vacuum resid-containing stream.

9. The process of claim 6, wherein at least a 10% increase in deasphalted oil yield is obtained as compared to utilizing the vacuum resid-containing stream as a feed to the solvent deasphalting unit.

10. The process of claim 6, wherein at least a portion of the deasphalted oil product stream is further processed in a process selected from a lubes extraction unit, a lubes hydrofinishing unit, a lubes catalytic dewaxing unit, and a lubes chilled dewaxing unit.

11. The process of claim 6, wherein the transmembrane pressure across the porous membrane element is greater than about 500 psi.

12. The process of claim 11, wherein the vacuum resid-containing stream is conducted to the membrane separations unit at a temperature from about 212 to about 572° F. (100 to 300° C.) and the transmembrane pressure is greater than about 750 psi.

13. A lubes bright stock production process, comprising:

a) conducting an atmospheric resid to a vacuum distillation tower;

b) retrieving a vacuum resid stream from the vacuum distillation tower;

c) conducting a vacuum resid-containing stream comprised of at least a portion of the vacuum resid stream to a membrane separations unit wherein the vacuum resid-containing stream contacts a first side of at least one porous membrane element;

d) retrieving a permeate product stream from the second side of the porous membrane element, wherein the permeate product stream is comprised of selective materials which pass through the porous membrane element from the first side of the porous membrane element to the second side of the porous membrane element;

e) retrieving a retentate product stream from the first side of the porous membrane element;

f) conducting at least a portion of the permeate product stream to a solvent deasphalting unit;

g) retrieving a deasphalted oil product stream from the solvent deasphalting unit;

h) conducting at least a portion of the deasphalted oil product stream to a lubes extraction unit wherein a low-aromatics lube extraction unit product stream is produced;

i) conducting at least a portion of the low-aromatics lube extraction unit product stream to a dewaxing process;

j) retrieving a lubes bright stock product stream from the dewaxing process; and k) blending at least a portion of the lubes bright stock product stream into a final lubrication oil product;

wherein the CCR wt % content of the permeate product stream is at least 20% lower than the CCR wt % content of the vacuum resid-containing stream, and the deasphalted oil product stream has a lower asphaltene wt % than said permeate product stream.

14. The process of claim 13, wherein the porous membrane element has an average pore size of about 0.001 to about 2 microns.

15. The process of claim 14, wherein the vacuum resid-containing stream is conducted to the membrane separations unit at a temperature from about 212 to about 662° F. (100 to 350° C.).

16. The process of claim 15, wherein the transmembrane pressure across the porous membrane element is greater than about 250 psi.

17. The process of claim 16, wherein the absolute viscosity (in centipoise at 100° C.) of the permeate product stream is at least 250 centipoise lower than the absolute viscosity (in centipoise at 100° C.) of vacuum resid-containing stream.

18. The process of claim 16, wherein the vacuum resid-containing stream is comprised of at least 50 wt % vacuum resid.

19. The process of claim 18, wherein the porous membrane element is comprised of a material selected from the group consisting of ceramics, metals, glasses, polymers, and combinations thereof.

20. The process of claim 19, wherein the transmembrane pressure across the porous membrane element is greater than about 500 psi.

21. The process of claim 20, wherein the vacuum resid-containing stream is conducted to the membrane separations unit at a temperature from about 212 to about 572° F. (100 to 300° C.) and the transmembrane pressure across the porous membrane element is greater than about 750 psi.

22. The process of claim 18, wherein the wt % of saturates in the permeate product stream is at least 25% greater than the wt % of saturates in the lubes vacuum resid-containing stream.

23. The process of claim 18, wherein at least a 10% increase in deasphalted oil yield is obtained as compared to utilizing the vacuum resid-containing stream as a feed to the solvent deasphalting unit.

* * * * *